US010424843B2

(12) United States Patent
Yman et al.

(10) Patent No.: US 10,424,843 B2
(45) Date of Patent: Sep. 24, 2019

(54) ANTENNA ARRANGEMENT USING INDIRECT INTERCONNECTION

(71) Applicant: CELLMAX TECHNOLOGIES AB, Kista (SE)

(72) Inventors: Niclas J. Yman, Ekerö (SE); Dan Karlsson, Sollentuna (SE); Stefan Jonsson, Sollentuna (SE)

(73) Assignee: CELLMAX TECHNOLOGIES AB, Kista (SE)

( * ) Notice: Subject to any disclaimer, the term of this patent is extended or adjusted under 35 U.S.C. 154(b) by 0 days.

(21) Appl. No.: 15/760,201

(22) PCT Filed: Sep. 15, 2016

(86) PCT No.: PCT/SE2016/050863
§ 371 (c)(1),
(2) Date: Mar. 14, 2018

(87) PCT Pub. No.: WO2017/048181
PCT Pub. Date: Mar. 23, 2017

(65) Prior Publication Data

US 2018/0277958 A1 Sep. 27, 2018

(30) Foreign Application Priority Data

Sep. 15, 2015 (SE) ..... 1551186

(51) Int. Cl.
*H01Q 9/16* (2006.01)
*H01Q 1/50* (2006.01)
(Continued)

(52) U.S. Cl.
CPC ..... *H01Q 9/16* (2013.01); *H01P 3/06* (2013.01); *H01P 5/026* (2013.01); *H01P 5/103* (2013.01);
(Continued)

(58) Field of Classification Search
CPC ..... H01Q 9/16; H01Q 19/108; H01Q 1/50; H01Q 1/246; H01Q 21/26; H01Q 19/10
See application file for complete search history.

(56) References Cited

U.S. PATENT DOCUMENTS 5,801,600 A 9/1998 Butland et al.
6,683,582 B1 1/2004 Love
(Continued)

FOREIGN PATENT DOCUMENTS

CN 102714354 A 10/2012
EP 0575808 A1 12/1993
(Continued)

OTHER PUBLICATIONS

PCT/SE2016/050863, International Search Report, dated Dec. 16, 2016, Patent-och registreringsverket Box 5055 S-102 42 Stockholm, Sweden.
(Continued)

*Primary Examiner* — Hai V Tran
(74) *Attorney, Agent, or Firm* — The Jansson Firm; Pehr B. Jansson

(57) ABSTRACT

An antenna arrangement comprising an antenna feeding network, an electrically conductive reflector and at least one radiating element arranged on said reflector is provided. The antenna feeding network comprises at least one substantially air filled coaxial line, each coaxial line comprising a central inner conductor and an elongated outer conductor at least partly surrounding the central inner conductor, wherein at least one radiating element and at least one coaxial line are configured to interconnect indirectly.

16 Claims, 4 Drawing Sheets

(51) Int. Cl.

| | |
|---|---|
| ***H01P 5/103*** | (2006.01) |
| ***H01Q 1/24*** | (2006.01) |
| ***H01Q 19/10*** | (2006.01) |
| ***H01Q 21/26*** | (2006.01) |
| ***H01P 3/06*** | (2006.01) |
| ***H01P 5/02*** | (2006.01) |

(52) U.S. Cl.
CPC ..... *H01Q 1/246* (2013.01); *H01Q 1/50* (2013.01); *H01Q 19/108* (2013.01); *H01Q 21/26* (2013.01)

(56) References Cited

U.S. PATENT DOCUMENTS

| | | | | |
|---|---|---|---|---|
| 2001/0048351 | A1 | 12/2001 | Love | |
| 2002/0135520 | A1 | 9/2002 | Teillet et al. | |
| 2002/0135527 | A1 | 9/2002 | Teillet et al. | |
| 2004/0203284 | A1* | 10/2004 | Stolle | H01Q 1/246 439/578 |
| 2004/0263389 | A1 | 12/2004 | Haunberger et al. | |
| 2005/0134517 | A1* | 6/2005 | Gottl | H01Q 1/246 343/797 |
| 2007/0241984 | A1 | 10/2007 | Schadler | |
| 2008/0139044 | A1 | 6/2008 | Hantsch et al. | |
| 2010/0001811 | A1 | 1/2010 | Haunberger et al. | |
| 2010/0007571 | A1 | 1/2010 | Riedel | |
| 2010/0201590 | A1 | 8/2010 | Girard et al. | |
| 2010/0201593 | A1* | 8/2010 | Jonsson | H01Q 1/246 343/824 |
| 2010/0283710 | A1 | 11/2010 | Lutman et al. | |
| 2013/0088402 | A1 | 4/2013 | Lindmark et al. | |
| 2014/0035698 | A1 | 2/2014 | Schadler et al. | |
| 2014/0139387 | A1 | 5/2014 | Jones et al. | |
| 2015/0109183 | A1 | 4/2015 | Smith | |
| 2015/0180135 | A1 | 6/2015 | Jonsson et al. | |
| 2015/0364832 | A1* | 12/2015 | Karlsson | H01Q 1/246 343/835 |

FOREIGN PATENT DOCUMENTS

| | | | |
|---|---|---|---|
| KR | 20100117838 | | 11/2010 |
| KR | 20100117838 | A | 11/2010 |
| WO | WO8605325 | A1 | 9/1986 |
| WO | WO02067374 | A1 | 8/2002 |
| WO | WO2005060049 | A1 | 10/2005 |
| WO | WO2005101566 | A1 | 10/2005 |
| WO | WO2006006913 | A1 | 1/2006 |
| WO | WO2009041896 | A1 | 4/2009 |
| WO | WO2012003506 | A2 | 1/2012 |
| WO | WO2012103821 | A2 | 8/2012 |
| WO | WO2014120062 | A1 | 8/2014 |
| WO | WO2017048181 | A1 | 3/2017 |
| WO | WO2017048182 | A1 | 3/2017 |

OTHER PUBLICATIONS

PCT/SE2016/050863, Written Opinion of the International Searching Authority, dated Dec. 16, 2016, Patent-och-registreringsverket Box 5055 S-102 42 Stockholm, Sweden.

PCT/SE2017/050087, International Search Report, dated May 4, 2017, Patent-och registreringsverket Box 5055 S-10242 Stockholm, Sweden.

PCT/SE2017/050087, Written Opinion of the International Searching Authority, dated May 4, 2017, Patent-och-registreringsverket Box 5055 S-10242 Stockholm, Sweden.

PCT/SE2017/050088, International Search Report, dated Apr. 28, 2017, Patent-och registreringsverket Box 5055 S-10242 Stockholm, Sweden.

PCT/SE2017/050088, Written Opinion of the International Searching Authority, dated Apr. 28, 2017, Patent-och-registreringsverket Box 5055 S-10242 Stockholm, Sweden.

PCT/SE2017/050618, International Search Report, dated Aug. 30, 2017, Patent-och registreringsverket Box 5055 S-10242 Stockholm, Sweden.

PCT/SE2017/050618, Written Opinion of the International Searching Authority, dated Aug. 30, 2017, Patent-och-registreringsverket Box 5055 S-10242 Stockholm, Sweden.

PCT/SE2016/050864, International Search Report, dated Nov. 30, 2016, Patent-och registreringsverket Box 5055 3-10242 Stockholm, Sweden.

PCT/SE2016/050864, Written Opinion of the International Searching Authority, dated Nov. 30, 2016, Patent-och-registreringsverket Box 5055 S-10242 Stockholm, Sweden.

PCT/SE2016/050867, International Search Report, dated Dec. 14, 2016, Patent-och registreringsverket Box 5055 S-10242 Stockholm, Sweden.

PCT/SE2016/050867, Written Opinion of the International Searching Authority, dated Dec. 14, 2016, Patent-och registreringsverket Box 5055 S-10242 Stockholm, Sweden.

PCT/SE2016/050868, International Search Report, dated Dec. 16, 2016, Patent-och registreringsverket Box 5055 S-10242 Stockholm, Sweden.

PCT/SE2016/050868, Written Opinion of the International Searching Authority, dated Dec. 16, 2016, Patent-och registreringsverket Box 5055 S-10242 Stockholm, Sweden.

* cited by examiner

ANTENNA ARRANGEMENT USING INDIRECT INTERCONNECTION

TECHNICAL FIELD

The present invention relates to an antenna arrangement for mobile communication, which antenna arrangement comprises an antenna feeding network, an electrically conductive reflector and at least one radiating element arranged on the reflector, wherein the antenna feeding network comprises at least one coaxial line.

BACKGROUND OF THE INVENTION

Multi-radiator antennas are frequently used in for example cellular networks. Such multi-radiator antennas comprise a number of radiating antenna elements for example in the form of dipoles for sending or receiving signals, an antenna feeding network and an electrically conductive reflector. The antenna feeding network distributes the signal from a common coaxial connector to the radiators when the antenna is transmitting and combines the signals from the radiators and feeds them to the coaxial connector when receiving. A possible implementation of such a feeding network is shown in FIG. 1.

In such a network, if the splitters/combiners consist of just one junction between 3 different 50 ohm lines, impedance match would not be maintained, and the impedance seen from each port would be 25 ohm instead of 50 ohm. Therefore the splitter/combiner usually also includes an impedance transformation circuit which maintains 50 ohm impedance at all ports.

A person skilled in the art would recognize that the feeding is fully reciprocal in the sense that transmission and reception can be treated in the same way, and to simply the description of this invention only the transmission case is described below.

The antenna feeding network may comprise a plurality of parallel substantially air filled coaxial lines, each coaxial line comprising a central inner conductor at least partly surrounded by an outer conductor with insulating air in between. The coaxial lines and the reflector may be formed integrally with each other. The splitting may be done via crossover connections between inner conductors of adjacent coaxial lines. In order to preserve the characteristic impedance, the lines connecting to the crossover element include impedance matching structures. The substantially air filled coaxial lines may be provided with a dielectric element to provide a phase shifting arrangement. The phase shift is achieved by moving the dielectric element that is located between the inner conductor and the outer conductor of a coaxial line. If the dielectric element is moved in such a way that the outer conductor will be more filled with dielectric material, the phase shift will increase. WO2009/041896 discloses an antenna arrangement provided with an adjustable differential phase shifter using such a movable dielectric element.

The radiating element is typically a dipole. A dipole usually may consist of two radiating parts having an electrical length of approximately one quarter of a wavelength at the operating frequency and extending essentially in plane parallel with the antenna reflector, and positioned approximately at a distance equivalent to one quarter of a wavelength at the operating frequency. The radiating parts are fed in counter-phase. Such a feeding is achieved by using a balanced-unbalanced transformer, also called a balun. In a dipole, it is often convenient to also use the balun as a mechanical support of the two radiating parts. The balun is often also used as an impedance matching element.

The balun consists of a body part and a coupling element which can also be seen as a conductor positioned in the centre of a cylindrical hole in the body part. The balun coupling element is electrically connected at one end to one of the radiating elements, and at the other end to a feeding line inner conductor.

The body part is usually connected to feeding line outer conductor and to the antenna reflector.

The connection between the radiating element and one of the inner conductors may be achieved using for example a screw joint. Thus, direct contact between the electrically conductive coupling element of the radiating element and an electrically conductive portion of the inner conductor is established. Such an arrangement has the disadvantage that it may be difficult and time consuming to assemble or manufacture since a screwed connection may be difficult to achieve in the very limited space available inside the outer conductor. Also, the screw and the coupling element are often inserted from opposite sides of the antenna which makes assembly difficult. Another disadvantage with the screw joint is that it may introduce passive intermodulation (PIM). Due to the small dimensions of the coupling element of the radiating element, the screw joint also needs to be of small dimensions, which makes it particularly difficult to achieve a connection which is sufficiently firm to avoid PIM.

SUMMARY OF THE INVENTION

An object of the present invention is to overcome at least some of the disadvantages of the prior art described above.

These and other objects are achieved by the present invention by means of an antenna arrangement and a method for manufacturing such an antenna arrangement according to the independent claims. Preferred embodiments are defined in the dependent claims.

According to a first aspect of the invention, an antenna arrangement comprising an antenna feeding network, an electrically conductive reflector and at least one radiating element arranged on said reflector is provided. The antenna feeding network comprises at least one substantially air filled coaxial line, each coaxial line comprising a central inner conductor and an elongated outer conductor at least partly surrounding the central inner conductor, wherein the at least one radiating element and at least one coaxial line are configured to interconnect indirectly.

In other words, one or a plurality of radiating elements, for example dipoles, are configured to connect electrically in an indirect manner with at least one coaxial line to achieve electrical connection for signals to/from the radiating element(s).

The invention is based on the insight that an antenna arrangement which is easy to assemble, yet provides high performance and low passive intermodulation, may be achieved by indirectly interconnecting at least one radiating element with a corresponding coaxial line, instead of connecting them galvanically. Such an indirect interconnection, i.e. capacitive or inductive interconnection or a combination of the two, between the radiating elements and the coaxial lines may provide an interconnection which may not suffer from the disadvantages associated with mechanical/galvanical connections discussed above.

Herein the word indirectly means that electrically conductive material of the radiating elements and coaxial lines are not in direct physical contact with each other, i.e. are non-galvanically connected. Indirectly thus means an inductive coupling, a capacitive coupling or a combination of the two.

It is understood that coaxial line refers to an arrangement comprising an inner conductor and an outer conductor with insulating or dielectric material or gas there between, where the outer conductor is coaxial with the inner conductor in the sense that it completely or substantially surrounds the inner conductor. Thus, the outer conductor does not necessarily have to surround the inner conductor completely, but may be provided with openings or slots, which slots may even extend along the full length of the outer conductor.

As described above, the at least one coaxial line is substantially air filled in the sense that each coaxial line is provided with air between the inner and outer conductors. The air between the inner and outer conductors thus replaces the dielectric often found in coaxial cables. In embodiments described below, the antenna feeding network may be provided with further components inside the outer conductor such as connector elements, support elements and dielectric elements which also occupies part of the space inside the outer conductor which would otherwise be filled with air. The coaxial line is thus substantially, but not completely, air filled in these embodiments.

In embodiments, the at least one radiating element and at least one coaxial line are configured to interconnect indirectly in the sense that the at least one radiating element and a central inner conductor of the at least one coaxial line are configured to interconnect indirectly, and/or in the sense that the at least one radiating element and an outer conductor of the at least one coaxial line are configured to interconnect indirectly. In one such embodiment, the at least one radiating element and a central inner conductor of the at least one coaxial line are configured to interconnect indirectly, while the radiating element and an outer conductor of the at least one coaxial line are configured to interconnect galvanically.

In embodiments, the at least one radiating element comprises a coupling element for interconnecting with the at least one central inner conductor. The indirect connection between the radiating element and the coaxial line may consist of an indirect connection between the coupling device and the inner conductor of the coaxial line, an indirect connection between the radiating element body and the coaxial line outer conductor, or a combination of both.

The at least one radiating element may each comprise two or more radiating parts which may extend essentially in plane parallel with the antenna reflector. The radiating parts may have an electrical length of approximately one quarter of a wavelength at the operating frequency and be positioned approximately at a distance equivalent to one quarter of a wavelength at the operating frequency. The radiating parts may be fed in counter-phase. Such a feeding may be achieved by using a balanced-unbalanced transformer, also called a balun, which may also form a mechanical support for the two radiating parts. The balun may also be used as an impedance matching element. The balun may consist of a body part and the coupling element which is positioned in the centre of a cylindrical hole in the body part. The body part may be connected to outer conductor and to the antenna reflector.

The indirect interconnection may be achieved by means of at least one insulating layer. The insulating layer may be arranged on the coupling element and/or on portions of the at least one inner conductor. The insulating layer may be provided by means of a coating on the coupling element and/or on the at least one inner conductor, the coating comprising at least one polymer and/or oxide material. Alternatively, the insulating layer may be a separate component of a non-conductive material placed between the coupling element and the at least one inner conductor.

In embodiments, the at least one radiating element comprises a coupling element which comprises a free end portion, wherein the coupling element is configured to interconnect with a central inner conductor of the at least one coaxial line via the free end portion. The at least one inner conductor may comprise a receiving cavity or through hole configured to receive the free end portion. In these embodiments, the insulating layer may be provided on the free end portion and/or in said cavity or through hole. The free end portion may be conically shaped. Alternatively, the free end portion may be cylindrically shaped. The cavity or through hole may also be conically or cylindrically shaped, preferably having the same shape as the free end portion such that the free end portion fits tightly in the cavity or through hole. Such a cavity or through hole thus has the function to help securing the position of the free end portion and thus the coupling element in a plane parallel to a plane defined by the electrically conductive reflector. As described above, the free end portion may be conically shaped, e.g. formed as an inverted cone. An inverted cone may simplify the connection by making it easier to guide the connector element into the cavity or through hole of the inner conductor. The receiving cavity or through hole may extend partially or all the way through the at least one inner conductor.

In embodiments, the antenna arrangement comprises a snap on mechanism, where the snap on mechanism comprises a snap on portion integrally arranged on the coupling element, at least in proximity of the free end portion, and a complementary snap on portion arranged on or forming a portion of the inner conductor.

The coupling element may comprise a conductor line portion, where the free end portion is formed with a step at an end of the conductor line portion. The free end portion or the step may have a greater diameter than the conductor line portion. The step may form the snap on portion of the coupling element.

The snap on mechanism may comprise a snap on bracket comprising the complementary snap on portion. The snap on bracket may be configured to be snapped around the at least one of the inner conductors. The snap on bracket may be made of a plastic material.

Although it has been described to use the step as snap on portion, the snap on portion may be embodied in another way such as for example a protrusion, a circumferential protrusion, a notch or a groove being arranged on the coupling conductor element.

The snap on mechanism may improve handling when connecting the radiating elements to the inner conductors. In embodiments, the snap on mechanism is releasably attachable.

In an alternative embodiment, the snap on mechanism comprises a dielectric support element configured to hold and at least partially surround the at least one of the inner conductors, wherein the dielectric support element comprises the complementary snap on portion. The dielectric support element may be configured to hold the inner conductor in position inside the outer conductor, and may be made of a plastic material.

The complementary snap on portion may be realized in the form of snap on fingers or extensions, which are configured to engage the snap on portion when the free end portion is in an engaged position. The engaged position may be when the free end portion is positioned on or in the inner conductor in order to provide an indirect electrical connection there between.

In embodiments, the snap on portion of the coupling element comprises a snap on bracket configured to engage with the complementary snap on portion of said inner conductor. The coupling element may comprise a conductor line portion, wherein the free end portion is formed at an end of the conductor line portion. The snap on bracket is preferably formed at the free end portion of the coupling element as a pair of snap on fingers. The complementary snap on portion may be provided in the form of a portion of the envelope surface of said inner conductor. The portion may be formed as a recess in the envelope surface, for example as a portion of the envelope surface having a smaller diameter than the adjacent portions of the envelope surface.

The embodiments described above may be combined in any way.

In embodiments, the radiator body has an insulating layer on its surface which is close to the coaxial line outer conductor, alternatively the coaxial line has an insulating layer where the radiator body is located, or an insulating film is inserted between the radiator body and the coaxial line outer conductor in order to create an indirect connection between the radiator body and the coaxial line outer conductor.

According to a second aspect of the invention, a method for manufacturing an antenna arrangement for mobile communication is provided. The method comprises providing an antenna feeding network comprising at least one substantially air filled coaxial line, each comprising a central inner conductor and an elongated outer conductor surrounding the central inner conductor, providing at least one radiating element, and interconnecting the radiating element and the at least one coaxial line indirectly.

In embodiments of the method according to the second aspect of the invention, the step of interconnecting comprises interconnecting the radiating element and the at least one central inner conductor of the at least one coaxial line indirectly, and/or interconnecting the radiating element and the outer conductor of the at least one coaxial line indirectly. In one such embodiment, the step of interconnecting comprises interconnecting the radiating element and the at least one central inner conductor of the at least one coaxial line indirectly, and interconnecting the radiating element and the outer conductor of the at least one coaxial line galvanically.

The description above of embodiments also applies to embodiments of the second aspect of the invention in an analogous manner.

BRIEF DESCRIPTION OF THE DRAWINGS

The present invention will now be described, for exemplary purposes, in more detail by way of embodiments and with reference to the enclosed drawings, in which.

DETAILED DESCRIPTION OF PREFERRED EMBODIMENTS

Figure 1:
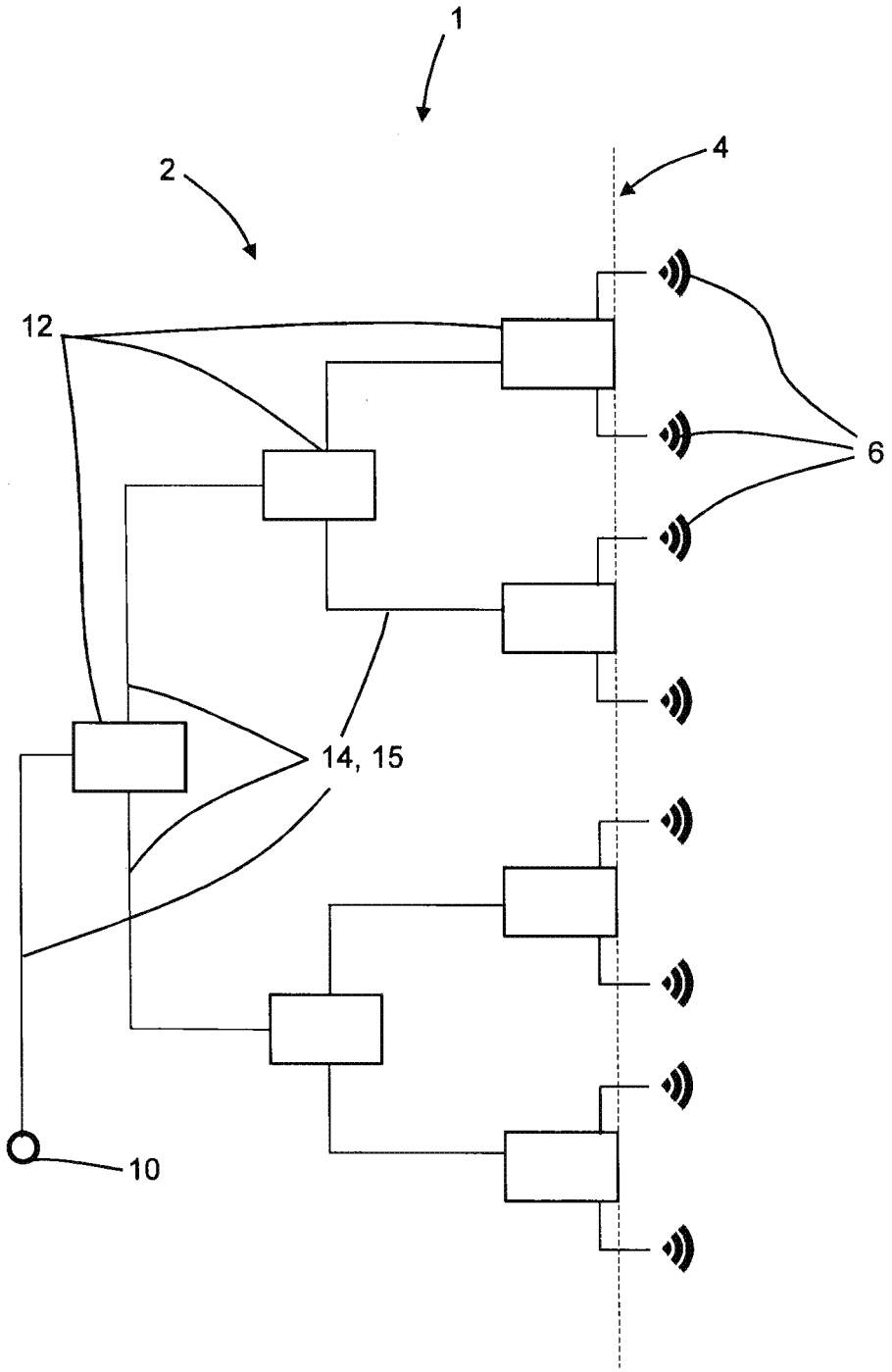
FIG. 1 schematically illustrates a feeding network of an antenna arrangement.

FIG. 1 schematically illustrates an antenna arrangement 1 comprising an antenna feeding network 2, an electrically conductive reflector 4, which is shown schematically in FIG. 1, and a plurality of radiating elements 6. The radiating elements 6 may be dipoles.

Figure 2:
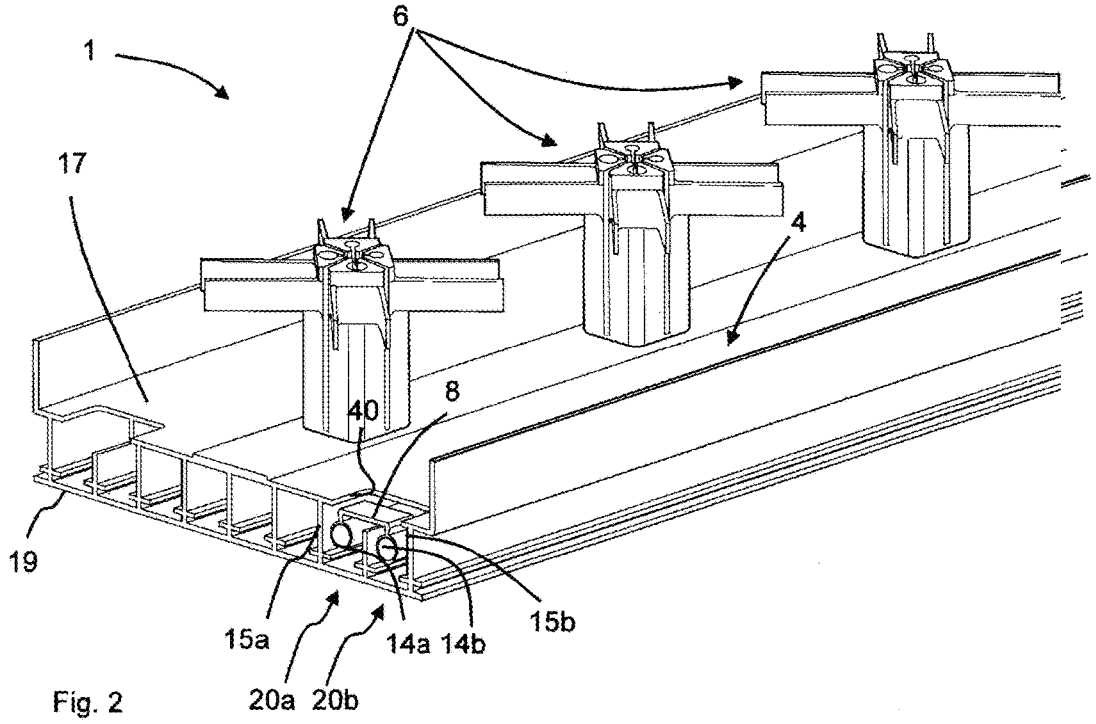
FIG. 2 schematically illustrates a perspective view of an embodiment of an antenna arrangement according to the first aspect of the invention.

The antenna feeding network 2 connects a coaxial connector 10 to the plurality of radiating elements 6 via a plurality of lines 14, 15, which may be coaxial lines, which are schematically illustrated in FIG. 1. The signal to/from the connector 10 is split/combined using, in this example, three stages of splitters/combiners 12. Turning now to FIG. 2, which illustrates an antenna arrangement 1 in a perspective view, the antenna arrangement 1 comprises the electrically conductive reflector 4 and the radiating elements 6.

The electrically conductive reflector 4 comprises a front side 17, where the radiating elements 6 are mounted and a back side 19.

FIG. 2 shows a first coaxial line 20*a* which comprises a first central inner conductor 14*a*, an elongated outer conductor 15*a* forming a cavity or compartment around the central inner conductor, and a corresponding second coaxial line 20*b* having a second inner conductor 14*b* and an elongated outer conductor 15*b*. The outer conductors 15*a*, 15*b* have square cross sections and are formed integrally and in parallel to form a self-supporting structure. The wall which separates the coaxial lines 20*a*, 20*b* constitute vertical parts of the outer conductors 15*a*, 15*b* of both lines. The first and second outer conductors 15*a*, 15*b* are formed integrally with the reflector 4 in the sense that the upper and lower walls of the outer conductors are formed by the front side 17 and the back side 19 of the reflector, respectively.

Although the first and second inner conductors 14*a*, 14*b* are illustrated as neighbouring inner conductors they may actually be further apart thus having one or more coaxial lines, or empty cavities or compartments, in between.

In FIG. 2, not all longitudinal channels or outer conductors are illustrated with inner conductors. It is however clear that they may comprise such inner conductors.

Figure 3:
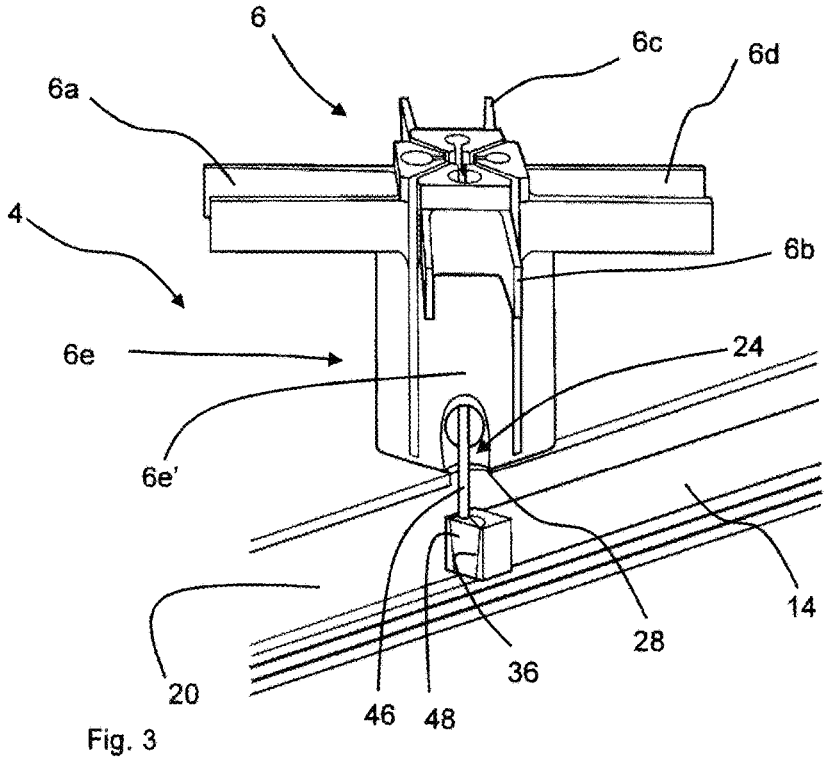
FIG. 3 schematically illustrates an embodiment of an antenna arrangement according to the first aspect of the invention, showing a perspective view onto a cross section cut through the middle of one of the radiating elements along a coaxial line.

Each of the radiating elements 6 is configured to be electrically connected to at least one of the inner conductors 14 via a coupling element 24 (c.f. FIG. 3).

The front side 17 of the reflector may comprise at least one opening 40 for the installation of a connector device 8.

The opening 40 extends over the two neighbouring coaxial lines 20*a*, 20*b* so that the connector device 8 can engage the inner conductors 14*a-b*.

FIG. 3 illustrates a perspective view onto a cross section cut through the middle of one of the radiating elements 6 in longitudinal direction of antenna arrangement. FIG. 3 also illustrates how the radiating element 6 is connected to one of the inner conductors 14. The radiating element 6 comprises a coupling element 24 having a conductor line portion 46 and a free end portion 48 at an end of the conductor line portion 46. The coupling conductor element 24 extends through the at least one opening 28 in the electrically conductive reflector 4 into a cavity or through hole 36 formed in the inner conductor 14.

The cavity or through hole 36 and the free end portion 48 of the coupling conductor element 24 are both conically shaped having corresponding diameter and rise to achieve a tight fit. The cavity or through hole 36 extends through the entire inner conductor 14, but may in other embodiments only extend partially into the inner conductor 14.

The coupling between the coupling element 24 and the inner conductor 14 is either capacitive, inductive or a combination therefore. This is achieved by providing a thin insulating layer on at least the free end portion 48 of the coupling element. In other embodiments, the cavity or through hole 36 comprises a thin insulating layer, while the free end portion does not. The insulating layer may have thickness of less than 50 μm, such as from 1 μm to 20 μm, such as from 5 μm to 15 μm, such as from 8 μm to 12 μm. In other embodiments, both the free end portion 48 and the cavity or through hole 36 comprise a thin insulating layer. The thin insulating layer could be provided by applying a thin layer of a polymer material, or by having a thin oxide layer, or by some other provisions applying an isolating layer.

The radiating elements 6 each comprise four identical radiating parts 6*a-d* forming a dipole. The radiating parts extend essentially in plane parallel with the antenna reflector. The radiating parts are fed using a balanced-unbalanced transformer 6*e*, also called a balun, which also forms a mechanical support for the radiating parts. As is further illustrated in FIG. 3, the balun comprises a body part 6*e*' and the coupling element 24 which is positioned in the centre of a cylindrical hole in the body part. The body part 6*e*' is connected to the outer conductor and to the antenna reflector.

Figure 4:
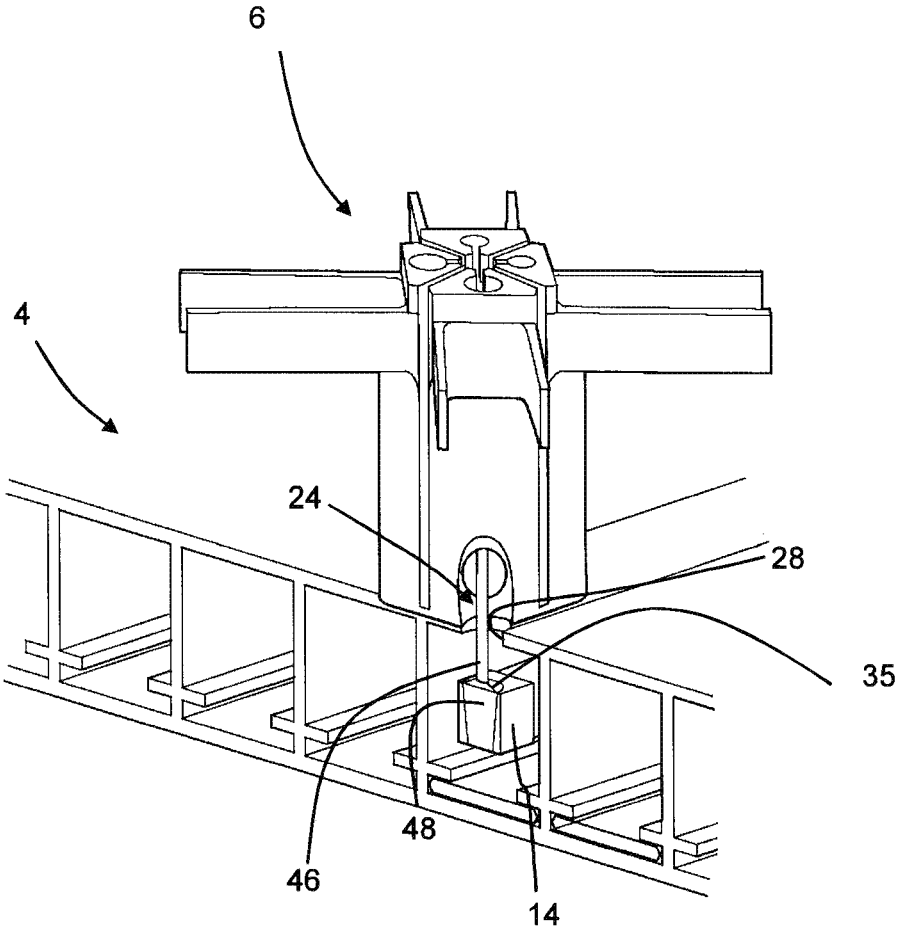
FIG. 4 schematically illustrates an embodiment of an antenna arrangement according to the first aspect of the invention, showing another perspective cross sectional view of the connection between the radiating element and the inner conductor, the cross section being cut perpendicular to the coaxial line.

FIG. 4 illustrates another perspective cross sectional view of the connection between the radiating element 6 and the inner conductor 14. The cross section is cut through the connection. The coupling element 24 and its enlarged free end portion 48 are shown. The free end portion 48 is conically inverted shaped and comprises a step 35 between the free end portion 48 and the conductor line portion 46. The free end portion 48 has a greater diameter than the conductor line portion 46.

Although the free end portion 48 has a conically inverted shaped it is conceivable that it has another shape such as cylindrical, cubical, etc. The shape of the cavity or through hole 36 may be adapted accordingly.

Figure 5:
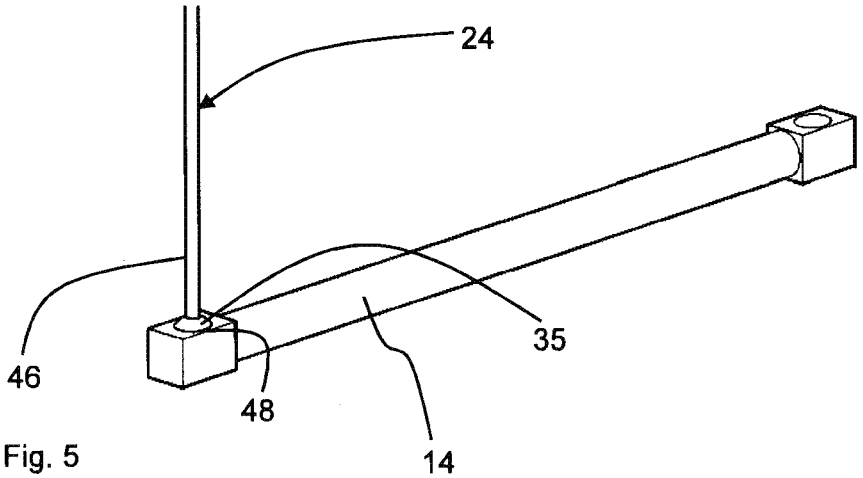
FIG. 5 schematically illustrates a view of a coupling element and an inner conductor of an embodiment of an antenna arrangement according to the first aspect of the invention.

FIG. 5 schematically illustrates the inner conductor 14 and the coupling conductor element 24 engaged in the cavity or through hole 36. As can be seen, the inner conductor 14 has a slightly greater diameter where the cavity or through hole 36 is shaped. This may be done for example for improved stability and/or a higher capacity of the indirect electric connection. The step 35 formed between the conductor line 46 and the enlarged free end portion 48 is also shown.

Figure 6:
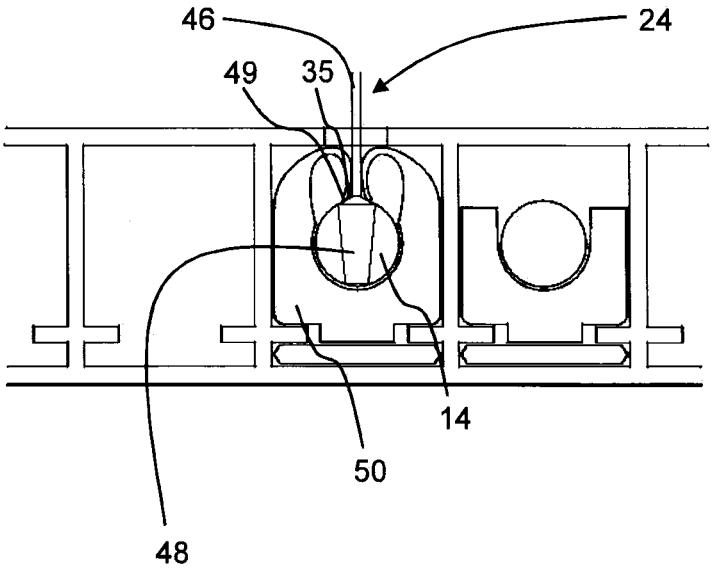
FIG. 6 schematically illustrates a cross section view of parts of an embodiment of an antenna arrangement according to the first aspect of the invention, which is provided with a snap-on mechanism.

FIG. 6 schematically illustrates a cross section view of parts of an antenna arrangement which comprise a snap on mechanism. The snap on mechanism has a snap on portion in the form of the step 35, which is integrally arranged on the coupling element 24 (only partially shown in the figure), above the free end portion 48, and a complementary snap on portion 49 arranged on the inner conductor 14. The complementary snap on portion 49 is formed as an edge of a dielectric support element 50 that is used to engage with and hold the inner conductor 14 in position within the outer conductor. The support element 50 is made from a plastic material which is slightly flexible which causes the opening in the spacer to widen slightly when the coupling element is pushed into the cavity or through hole of the inner conductor. After the coupling element has been pushed down, the edge/snap on portion 49 prevents it from accidentally leaving the cavity or through hole. In other embodiments, the complementary snap on portion is formed on a separate component which is not a dielectric support element.

Figure 7:
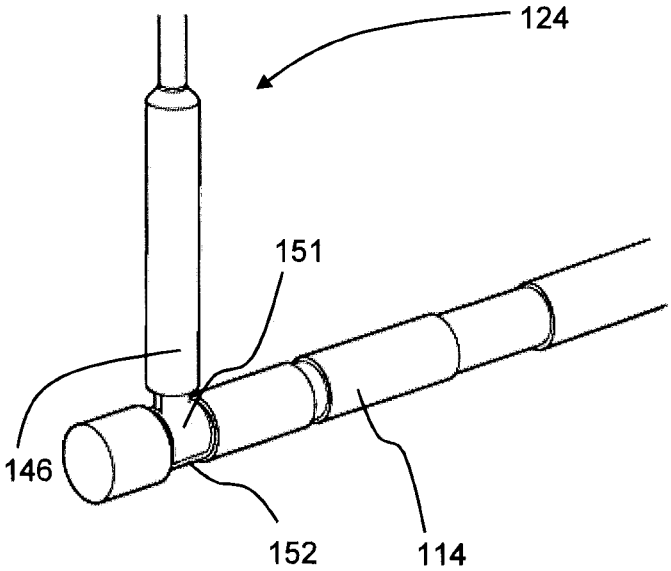
FIG. 7 schematically illustrates a view of a coupling element and an inner conductor of an alternative embodiment of an antenna arrangement according to the first aspect of the invention.

FIG. 7 schematically illustrates parts of an alternative embodiment of an antenna arrangement according to the first aspect of the invention. The figure shows an inner conductor 114 and a coupling conductor element 124 engaged with the inner conductor. The coupling element 124 is provided with a conductor line portion 146, wherein the free end portion is formed at an end of the conductor line portion, wherein a snap on portion is provided at the free end portion of the coupling element as a pair of snap on fingers 151 (only one is visible in the figure). The complementary snap on portion is provided in the form of a recessed portion 152 of the envelope surface of said inner conductor. The recessed portion has a smaller diameter than the adjacent portions of the envelope surface and has a length (in the longitudinal direction) which corresponds to that of the snap on fingers 151. The snap on fingers 151 may be described as a pair of protrusions configured to engage around the inner conductor, which fingers or protrusions may be configured to be flexible to allow the coupling element to be removably connectable to the inner conductor.

The coupling between the coupling element 124 and the inner conductor 114 is either capacitive, inductive or a combination therefore. This is achieved by providing a thin insulating layer on at least the surface portions of the snap on fingers 151 which are in abutment with the inner conductor, or on the whole coupling element or snap on finger portion thereof. In other embodiments, the inner conductor 114, or at least the recessed portion 152 thereof, comprises a thin insulating layer, while the snap on fingers do not. The insulating layer may have thickness of less than 50 μm, such as from 1 μm to 20 μm, such as from 5 μm to 15 μm, such as from 8 μm to 12 μm. In other embodiments, both the snap on fingers and the recessed portion comprise a thin insulating layer. The thin insulating layer could be provided by applying a thin layer of a polymer material, or by having a thin oxide layer, or by some other provisions applying an isolating layer.

It is understood that the alternative embodiment shown in FIG. 7 and described above only differs in the above described details relating to the interconnection between the coupling element and the inner conductor. Apart from this, the description above relating to FIGS. 2-4 applies analogously to this embodiment.

The description above and the appended drawings are to be considered as non-limiting examples of the invention. The person skilled in the art realizes that several changes and modifications may be made within the scope of the invention. For example, the number of coaxial lines may be varied and the number of radiators/dipoles may be varied. Furthermore, the shape of the coupling element and inner conductors and the placement of the insulating layer or coating may be varied. Furthermore, the reflector does not necessarily need to be formed integrally with the coaxial lines, but may on the contrary be a separate element. The scope of protection is determined by the appended patent claims.

The invention claimed is:

1. An Antenna arrangement comprising an antenna feeding network, an electrically conductive reflector and at least one radiating element arranged on said reflector, the antenna feeding network comprising at least one substantially air filled coaxial line, each of the coaxial line comprising a central inner conductor and an elongated outer conductor surrounding the central inner conductor, wherein the at least one radiating element and the central inner conductor of said at least one coaxial line interconnect indirectly, wherein said at least one radiating element comprises a coupling element for interconnecting with the at least one central inner conductor, wherein the coupling element comprises a free end portion, wherein said at least one radiating element interconnects with said at least one central inner conductor via said free end portion, wherein said antenna arrangement further comprises a snap on mechanism, wherein the snap on mechanism comprises a snap on portion integrally arranged on the coupling element, at least in proximity of the free end portion, and a complementary snap on portion arranged on the inner conductor.

2. The antenna arrangement according to claim 1, wherein the at least one radiating element and the at least one coaxial line are configured to interconnect capacitively and/or inductively.

3. The antenna arrangement according to claim 1, further comprising at least one insulating layer arranged to provide the indirect interconnection.

4. The antenna arrangement according to claim 3, wherein the insulating layer is arranged on the coupling element and/or on said at least one inner conductor.

5. The antenna arrangement according to claim 3, wherein the insulating layer is placed between the coupling element and said at least one inner conductor.

6. The antenna arrangement according to claim 1, wherein said at least one inner conductor comprises a receiving cavity or through hole.

7. The antenna arrangement according to claim 1, wherein the free end portion is conically formed.

8. The antenna arrangement according to claim 1, wherein the coupling element comprises a conductor line portion, and wherein said free end portion is formed with a step at an end of said conductor line portion, said free end portion having a greater diameter than the conductor line portion, wherein said step forms said snap on portion.

9. The antenna arrangement according to claim 1, wherein the snap on mechanism comprises a snap on bracket comprising the complementary snap on portion, and wherein the snap on bracket is configured to be snapped around the at least one of the inner conductors.

10. The antenna arrangement according to claim 1, wherein the snap on mechanism comprises a dielectric support element configured to hold and at least partially surround the at least one of the inner conductors, wherein the dielectric support element comprises the complementary snap on portion.

11. The antenna arrangement according to claim 1, wherein the complementary snap on portion is realized in the form of snap on fingers, which are configured to engage the snap on portion when the free end portion is in an engaged position.

12. The antenna arrangement according to claim 1, wherein the electrically conductive reflector comprises an opening and wherein the coupling element extends through the opening to the inner conductor.

13. The antenna arrangement according to claim 1, wherein the snap on portion of said coupling element comprises a snap on bracket configured to engage with said complementary snap on portion arranged on said inner conductor.

14. The antenna arrangement according to claim 13, wherein said snap on bracket is formed at the free end portion of said coupling element as a pair of snap on fingers.

15. The antenna arrangement according to claim 14, wherein said complementary snap on portion is provided in the form of a portion of the envelope surface of said inner conductor.

16. The antenna arrangement according to claim 15, wherein said portion is formed as a recess in said envelope surface.

* * * * *